US006957972B2

(12) United States Patent
Starke et al.

(10) Patent No.: US 6,957,972 B2
(45) Date of Patent: Oct. 25, 2005

(54) ELECTRICAL CONNECTOR

(75) Inventors: Cord Starke, Blomberg (DE); Valeri Reimchen, Steinheim (DE); Markus Becker, Paderborn (DE)

(73) Assignee: Phoenix Contact GmbH, Blomberg (DE)

( * ) Notice: Subject to any disclaimer, the term of this patent is extended or adjusted under 35 U.S.C. 154(b) by 0 days.

(21) Appl. No.: 10/725,797

(22) Filed: Dec. 2, 2003

(65) Prior Publication Data

US 2005/0118853 A1 Jun. 2, 2005

(51) Int. Cl.[7] ..... H01R 13/62
(52) U.S. Cl. ..... 439/320; 439/359; 439/216
(58) Field of Search ..... 439/320–321, 439/359, 216; 285/391

(56) References Cited

U.S. PATENT DOCUMENTS

| | | | | | |
|---|---|---|---|---|---|
| 3,281,755 | A | * | 10/1966 | Trager | 439/320 |
| 4,060,299 | A | * | 11/1977 | Williams | 439/289 |
| 4,440,464 | A | * | 4/1984 | Spinner | 439/218 |
| 4,479,748 | A | | 10/1984 | Uhlmann | 411/412 |
| 4,557,546 | A | * | 12/1985 | Dreyer | 439/584 |
| 5,035,640 | A | * | 7/1991 | Drogo | 439/321 |
| 6,099,329 | A | | 8/2000 | Goff et al. | 439/131 |
| 6,135,800 | A | * | 10/2000 | Majors | 439/321 |
| 6,280,229 | B1 | * | 8/2001 | Harting et al. | 439/393 |
| 6,350,139 | B1 | * | 2/2002 | Haag | 439/320 |
| 6,764,351 | B2 | * | 7/2004 | Finzer et al. | 439/752 |
| 2003/0013338 | A1 | | 1/2003 | Birkenmaier et al. | 439/332 |

FOREIGN PATENT DOCUMENTS

| | | |
|---|---|---|
| DE | 3022102 | 11/1981 |
| DE | 29618581 | 1/1998 |
| DE | 19960768 | 7/2001 |
| DE | 10003924 | 8/2001 |
| DE | 10233075 | 2/2004 |
| EP | 0431408 | 6/1991 |
| EP | 1289073 | 3/2003 |

* cited by examiner

*Primary Examiner*—Truc Nguyen
(74) *Attorney, Agent, or Firm*—Davidson, Davidson & Kappel, LLC

(57) ABSTRACT

An electrical connector includes a plug which is designed as a threaded sleeve for screwing on a union nut or for screwing into a stationary housing component of an electronic device. The external thread of the threaded sleeve has at least one threadless area provided in the plug-in direction into which a matching internal thread of a union nut or of a housing can be plugged in almost completely, in such a way that tightening of the threaded joint is reduced to one half or maximum a full revolution. The construction allows for the use of complete screw threads and thus the combination with standard connectors of the same commercially available size and type of connection.

17 Claims, 5 Drawing Sheets

ELECTRICAL CONNECTOR

The present invention relates to an electrical connector having a plug connector which is designed as a threaded sleeve for screwing on a union nut of a socket connector which is connectable to the plug.

BACKGROUND

It is known in connectors to protect the plug and socket against unintentional separation by using a union nut. In order to prevent the screwed connection from disengaging, the union nut is usually screwed onto the corresponding external thread of the plug up to an axial stop, which is frequently axially sealed by an O-ring seal or the like, and tightened. If, in the event of damage, the plug and socket connection must be disengaged quickly and a damaged part must be replaced, the time required for engaging and disengaging such a plug and socket connection is a disadvantage in these known connectors.

It is known from DE 100 03 924 A1 that a plug connector can be detachably connected to a socket connector by using a bayonet lock. For this purpose, matching links are located on the external surfaces of the guide sleeves and the receptacle of the connector. These links, together with correspondingly located guide pegs, ensure a tight connection when the connector is engaged and the guide sleeve is twisted. Due to the mechanical stress of the guide pegs and the matching link, this type of connection is not used for the axial connection of connectors having a small cross section.

A coaxial HF connector is known from DE 30 22 102 C1 in which at least one of the connectors is designed as a threaded sleeve having an external thread and onto which either a socket connector or a socket having a bayonet lock can be screwed in, i.e., fastened by a twisting lock. However, the insertion forces and withdrawal forces during engaging and disengaging, which occur during handling of this connector, are not very strong due to the usual omission of seals, so that only minor stresses occur for the locking lugs.

An electrical connector in which the corresponding socket can be fastened on the plug using a union nut is known from DE 296 18 581 U1. Here, the union nut contains an internal thread for the connection to a plug having an external thread, as well as profile-shaped recesses for the connection to a plug having external pegs, a bayonet connection for example. It is a disadvantage that the external pegs withstand only low stresses with regard to the occurring insertion forces and withdrawal forces. Since the complete plug-in path must be used when screwing on the union nut, a quick assembly of the plug and socket connection is not possible when the screwed connection is used.

An electrical connector having a bayonet lock is known from EP 0 431 408 A2. Quick assembly is achieved here in that a guide groove for receiving a guide rib has a high pitch. However, the nearly constant high pitch cannot meet the different requirements with regard to a tight fit.

An electrical connector in which the threaded sleeve is composed of only two sections is known from U.S. Pat. No. 6,099,329. Since the threaded sleeve no longer has a closed cylindrical shape, such a connector is unstable and cannot be lastingly and reliably held. Insertion forces, withdrawal forces, and torsional forces during the plug-in procedure can easily result in damage to the sections of the threaded sleeve.

The patent document references cited herein are hereby incorporated by reference herein.

SUMMARY OF THE INVENTION

High demands with regard to robustness and tightness are made on connectors which are provided for industrial use in machines, sensors, and electronic devices distributing signals or voltage. Seals using ring seals have proven to be of value in the tough industrial environment. In addition, in the event of malfunctions of the machine and replacement of broken-down components, sensors, or electronic devices, their connecting lines must be quickly disconnected from these devices for removal of those components. Thus, in connectors presently used, a substantial expenditure in time is associated with disengaging the particular threaded joint. Compared to the related art, the present invention provides for a robust type of fastening which minimizes the presently substantial time expenditure and which, in addition, ensures the connection of commercially available connectors.

In the present invention a screw thread is used for this type of connector in which, due to the screw-on action, a seal is squeezed together close to the axial joinability limit in order to protect the contacts from the rough environmental effects frequently present.

The present invention provides an electrical connector having a plug which is designed as a threaded sleeve for screwing on a union nut or for screwing into a stationary housing component of an electronic device, in which the external thread of the threaded sleeve has at least one threadless area provided in the plug-in direction into which a matching internal thread of a union nut or of a housing can be plugged in almost completely, in such a way that tightening of the threaded joint is reduced to one half or maximum a full revolution. In addition, the construction allows for the use of complete screw threads and thus the combination with standard connectors of the same commercially available size and type of connection.

DETAILED DESCRIPTION

Figure 1:
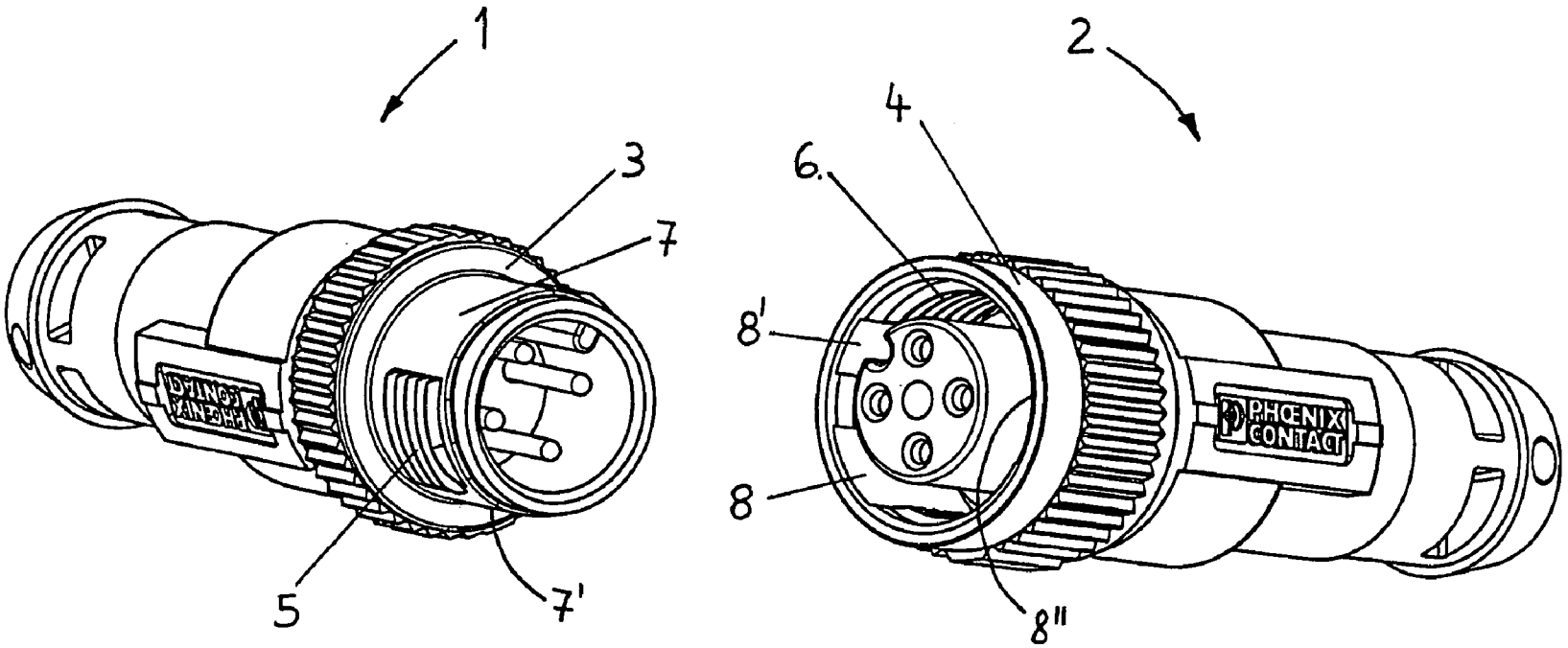
FIG. 1 shows two connectors including a threaded sleeve having an external thread and a union nut having an internal thread.

In the overall construction of their components, connectors 1, 2 according to FIG. 1 are distinguishable from commercially available connectors, for sensor connections or valve connections for example, by the use of novel screw connections in the form of a threaded sleeve 3 and a union nut 4. In their external outline, threaded joint components 3 and 4 are compatible with the commercially available connectors of this type. The compatibility enables commercially available connectors and connectors 1, 2 according to FIG. 1 having the features for quick connection to be combined without disadvantage.

An external thread is provided on threaded sleeve 3 according to FIG. 1, which exists, however, only in some areas 5 of the circumference of threaded sleeve 3. Positioning of these threaded areas 5 creates threadless areas 7, 7' which may receive an internal threaded area 6 of a union nut. In contrast, socket 2 has a union nut 4 including an internal thread 6 which has threadless areas 8, 8', 8" and threaded areas 6 which are situated opposite the joining position.

Figure 2:
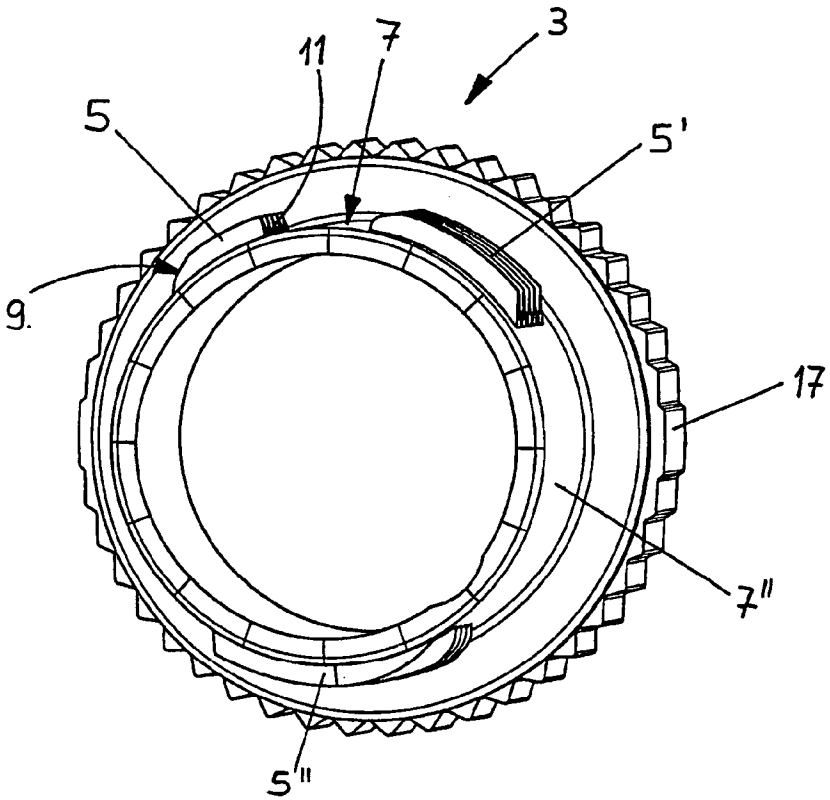
FIG. 2 shows a threaded sleeve having an external thread in some areas and threadless areas between these threaded areas.

FIG. 2 shows a perspective view of this threaded sleeve 3 including the knurl for twisting threaded sleeve 3, which facilitates handling; threaded areas 5, 5', 5" and their arrangement are also shown. Although an asymmetrical positioning of thread areas 5, 5', 5" is shown on the circumference of threaded sleeve 3, a symmetrical arrangement in a simplified form may also be possible. However, the asymmetrical arrangement has the advantage that joining is only possible in one position when turning one revolution, which is advantageous for fastening connector 1 when a highly flexible seal 14 according to FIG. 4 is used so that, due to the thread pitch, a larger angle of twist of threaded sleeve 3, close to a complete revolution, becomes necessary.

Figure 3:
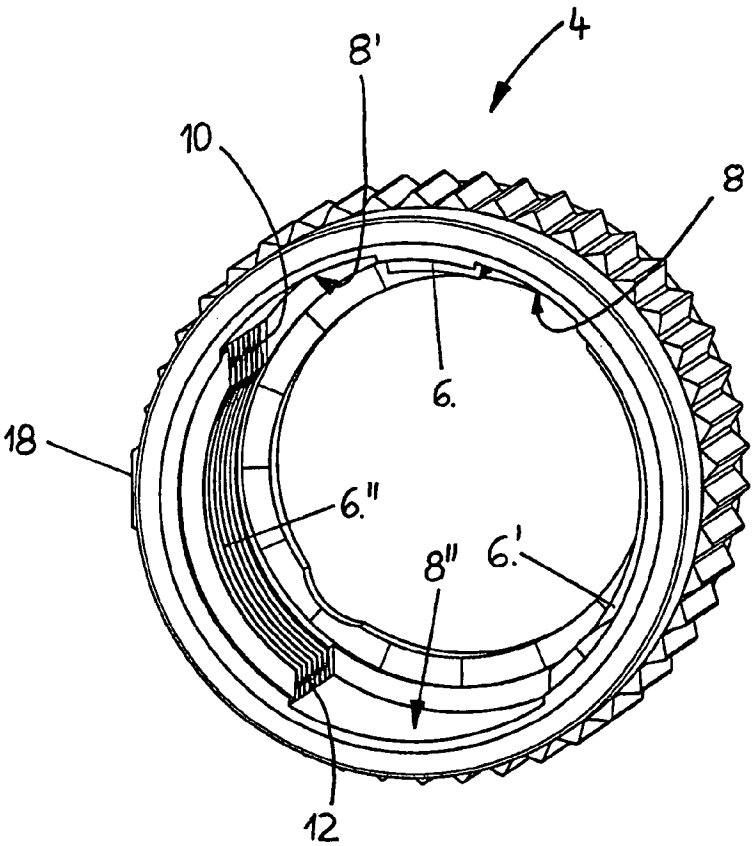
FIG. 3 shows a union nut having an internal thread in some areas and threadless areas between these internal threaded areas.

In FIG. 3, similarly to threaded sleeve 3, union nut 4 has internal threadless areas 8, 8', 8" in the areas being located opposite one another when both components are plugged together. Thus, the radially protruding threaded areas 5, 5', 5" of threaded sleeve 3, whose extension in the circumferential direction is adapted to the threadless areas of union nut 4, may be inserted into one another until seal 14 limits the plug-in action in the joining direction X—X according to FIG. 4. In a symmetrical arrangement of threaded areas 5, 5', 5", 6, 6', 6" on the circumference of both components, threadless areas 7, 7', 7", 8, 8', 8" of the same size are situated on the particular mating piece in the identical circumferential position so that the largest possible overlap area of the load-supporting thread is achieved. In particular, for easily finding the joining position of the plug pattern by twisting in the circumferential direction, external markings 17, 18 are applied to the outside of the knurl which enable threaded sleeve 3 and union nut 4 to be plugged together when the positions of both markings match, the markings advantageously being color markings or, as shown in FIG. 2 and FIG. 3, a knurl-free surface creating a prominent visual point.

Figure 4:
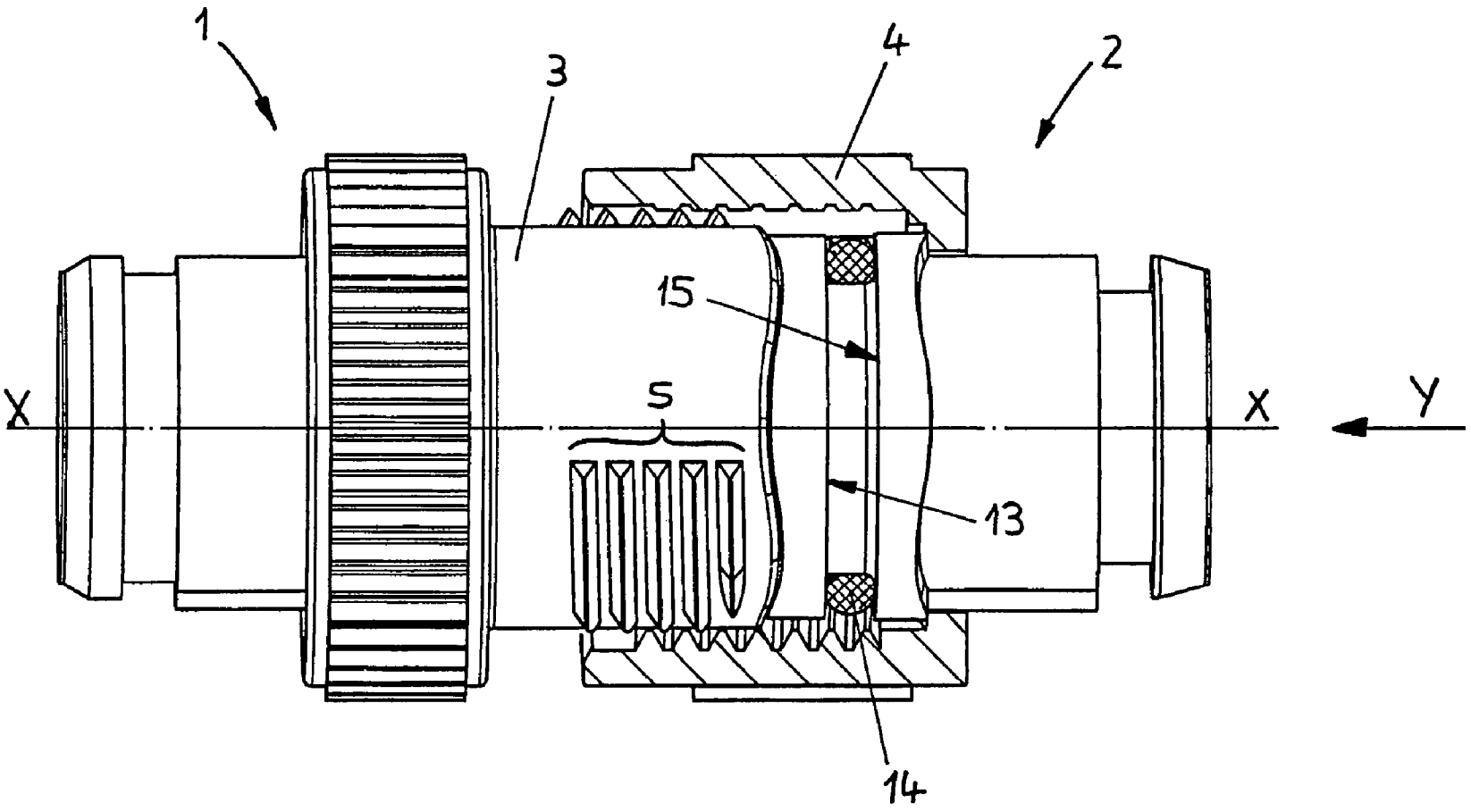
FIG. 4 shows a threaded sleeve which is screwed together with a union nut, the threaded sleeve having an arrangement of insulating parts which accommodate contacts and which flexibly seal the contact area using an O-ring seal.

FIG. 4 shows the arrangement where threaded sleeve 3 and union nut 4 are screwed together. A ring-shaped seal 14, which is typically designed as an O-ring, is squeezed together between the components and their axially aligned contact surfaces 13 and 15 of both connectors 1 and 2 in the joining direction Y, so that the insulated contacts situated in the connector are protected from the to some extent adverse environmental effects.

Figure 5:
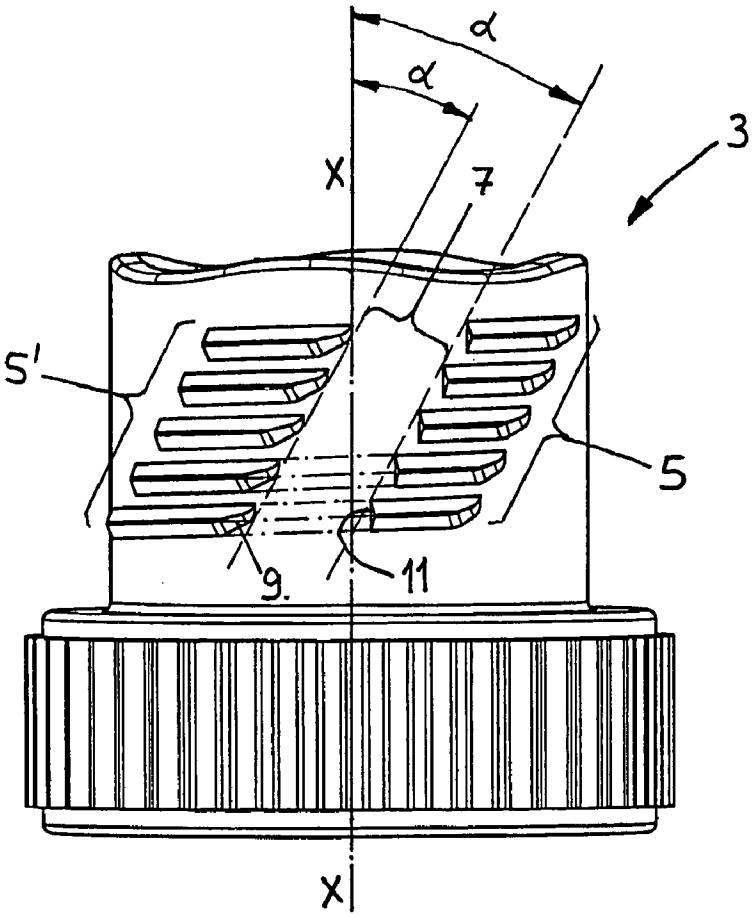
FIG. 5 shows a threaded sleeve having an external thread in which the threaded areas are separated by threadless areas in such a way that the threadless area is angled with respect to the plug-in and joining direction.

FIG. 5 shows an advantageous embodiment of the alignment of the threadless areas. The alignment of the threadless area on the surface of threaded sleeve 3 and similarly in union nut 4 make a slight initial twist of the particular component possible during handling. The overall alignment of threadless areas 7, 7', 7" on threaded sleeve 3 or similarly of threadless areas 8, 8', 8" in union nut 4 is positioned at the same angle alpha for both components, so that threaded areas 5, 5', 5", 6, 6', 6", corresponding to those threadless areas, must be positioned at the same angle. The positions of these areas also coincide correspondingly in the circumferential direction.

To ensure the screwing-on of union nut 4, it goes without saying that, before and after a threadless area 7, 7', 7", the thread is aligned with the counterthread as necessary. This makes it possible to also use commercially available connectors 1, 2 having a full thread for both types of plug connectors. In the combination of connectors having a different plug pattern, a symmetrical arrangement of the threadless areas or an asymmetrical arrangement of these areas for example, these connectors act vis-à-vis another connector like a commercially available connector having a full thread in which the components may be fastened to one another in the conventional time-consuming manner.

Figure 6:
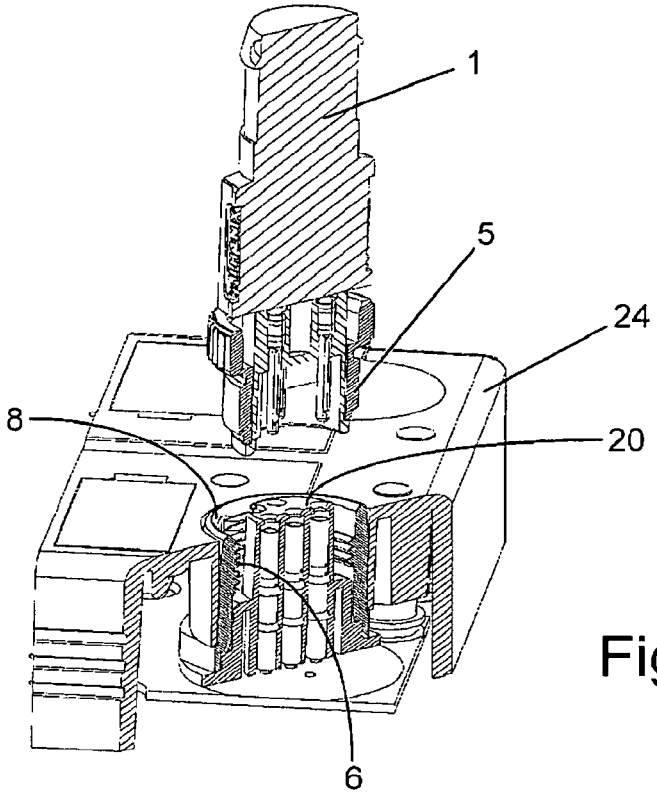
FIG. 6 shows a perspective view of two connectors including a threaded sleeve having an external thread and a stationary housing component with a socket device having an internal thread.
Figure 7:
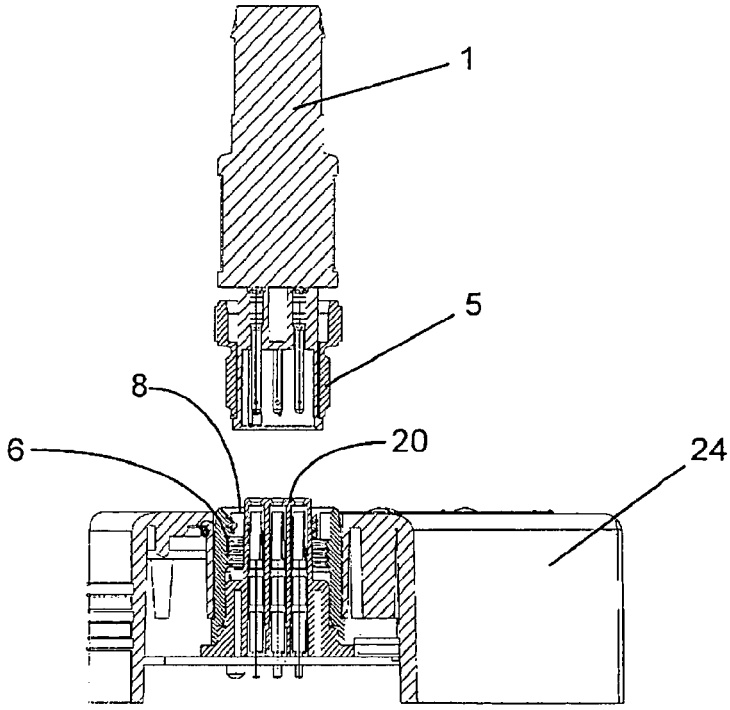
FIG. 7 shows a side partial cut-away view of the connectors of FIG. 6.

FIGS. 6 and 7 show a further embodiment in which a stationary housing component 24 of a socket device 20 having a receiving thread comparable to that of union nut 4 is provided instead of a socket 2 having a union nut 4. If the design of the internal thread of socket device 20 is adapted to the requirements of internal threaded areas 6, 6', 6" of union nut 4 according to the present invention, the time-consuming handling of fastening plug 1 is minimized, even when it is being connected directly to the socket device. Thus, in this embodiment socket device 20 includes internal threaded areas 6, 6', 6" and threadless areas 8, 8', 8", and plug connector 1 includes matching external threads 5, 5', 5".

What is claimed is:

1. An electrical connector comprising:

a plug including a threaded sleeve, the threaded sleeve including an external thread having at least one threadless area; and a socket connectable to the plug and including a union nut, the union nut including an internal thread configured for threaded engagement with the external thread of the plug;

wherein the internal thread of the union nut is configured to be received by the at least one threadless area and tightened onto the external thread; the at least one threadless area includes a plurality of threadless areas; and the internal thread includes a plurality of threaded areas matching the threadless areas.

2. The electrical connector as recited in claim 1 wherein the threadless areas and the matching threaded areas are disposed at a respective same angle relative to a respective axial connector axis of the plug and the socket.

3. The electrical connector as recited in claim 1 wherein the threaded areas are disposed in an even distribution at a circumference of the threaded sleeve.

4. The electrical connector as recited in claim 1 wherein the threadless areas and the matching threaded areas are disposed in an uneven distribution at a respective circumference of the threaded sleeve and the union nut.

5. The electrical connector as recited in claim 2 wherein the threaded areas are disposed in an even distribution at a circumference of the threaded sleeve.

6. The electrical connector as recited in claim 2 wherein the threadless areas and the matching threaded areas are disposed in an uneven distribution at a respective circumference of the threaded sleeve and the union nut.

7. The electrical connector as recited in claim 3 wherein the threadless areas and the matching threaded areas have a respective different length in a circumferential direction so that a full revolution is required for disengaging a connection of the plug and socket.

8. The electrical connector as recited in claim 5 wherein the threadless areas and the matching threaded areas have a respective different length in a circumferential direction so that a full revolution is required for disengaging a connection of the plug and socket.

9. The electrical connector as recited in claim 4 wherein the threadless areas and the matching threaded areas have a respective different length in a circumferential direction so that a full revolution is required for disengaging a connection of the plug and socket.

10. The electrical connector as recited in claim 6 wherein the threadless areas and the matching threaded areas have a respective different length in a circumferential direction so that a full revolution is required for disengaging a connection of the plug and socket.

11. An electrical connector comprising:

a plug including a threaded sleeve, the threaded sleeve including an external thread having at least one threadless area; and a socket connectable to the plug and including a union nut, the union nut including an internal thread configured for threaded engagement with the external thread of the plug;

wherein the internal thread of the union nut is configured to be received by the at least one threadless area and tightened onto the external thread; the external thread includes a respective individual first thread on each side of the at least one threadless area, the individual first threads being aligned with each other; the internal thread includes respective individual second threads; and the individual first and second threads each have a respective chamfer at a start of the respective thread so as to enable an easier insertion of a counterthread area when tightening the internal thread onto the external thread.

12. An electrical connector comprising:

a plug including a threaded sleeve, the threaded sleeve including an external thread having at least one threadless area; and a socket connectable to the plug and including a union nut, the union nut including an internal thread configured for threaded engagement with the external thread of the plug;

wherein the internal thread of the union nut is configured to be received by the at least one threadless area and tightened onto the external thread; the external thread includes a respective individual first thread on each side of the at least one threadless area, the individual first threads being aligned with each other; the internal thread includes respective individual second threads; and the individual first and second threads each include a respective sharp edge at an end of the respective thread so as to prevent turning past a tangential removal position when unscrewing the internal thread from the external thread.

13. The electrical connector as recited in claim 12 wherein the plug and the socket are configured so that an O-ring seal disposed between the plug and the socket causes at least one of the plug and the socket to be lifted slightly out of a respective flight of the internal or external thread so as to prevent a turning of the internal or the external thread past a tangential removal position.

14. An electrical connector comprising:

a plug including a threaded sleeve, the threaded sleeve including an external thread not having a threadless area; and a socket connectable to the plug and including a union nut, the union nut including an internal thread configured for threaded engagement with the external thread of the plug, the internal thread having at least one threadless area.

15. An electrical connector comprising:

a plug including a threaded sleeve, the threaded sleeve including an external thread having a plurality of threadless areas; and a socket disposed in a stationary housing component and connectable to the plug, the socket including an internal thread configured for threaded engagement with the external thread of the plug;

wherein the internal thread of the socket includes a plurality of threaded areas matching and configured to receive the threadless areas for tightening the external thread onto the internal thread.

16. The electrical connector as recited in claim 15 wherein the threadless areas and the matching threaded areas are disposed at a respective same angle relative to a respective axial connector axis of the plug and the socket.

17. An electrical connector comprising:

a plug including a threaded sleeve, the threaded sleeve including an external thread having at least one threadless area; and a socket connectable to the plug and including a union nut, the union nut including an internal thread configured for threaded engagement with the external thread of the plug;

wherein the internal thread of the union nut includes at least one threaded area matching the at least one threadless area and configured to be received by the at least one threadless area and tightened onto the external thread.

* * * * *